US007225867B2

(12) United States Patent
Mackenzie et al.

(10) Patent No.: US 7,225,867 B2
(45) Date of Patent: Jun. 5, 2007

(54) LINER TOP TEST PACKER

(75) Inventors: Gordon Robert James Mackenzie, Cypress, TX (US); Mark Edward Plante, Cypress, TX (US); Richard Travis White, Kingwood, TX (US); David Alan Dolyniuk, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/106,019

(22) Filed: Apr. 14, 2005

(65) Prior Publication Data

US 2005/0230108 A1 Oct. 20, 2005

(51) Int. Cl.
*E21B 47/10* (2006.01)

(52) U.S. Cl. ..... 166/250.08; 166/55.6; 166/66; 166/298; 166/196; 166/387

(58) Field of Classification Search ..... 166/382, 166/387, 196, 134, 138, 55.6, 298, 250.08, 166/66

See application file for complete search history.

(56) References Cited

U.S. PATENT DOCUMENTS 3,142,338 A * 7/1964 Brown ..... 166/120
4,662,453 A * 5/1987 Brisco ..... 166/387
4,942,925 A * 7/1990 Themig ..... 166/382

FOREIGN PATENT DOCUMENTS

WO WO 01/83938 A1 * 11/2001

* cited by examiner

*Primary Examiner*—Hoang Dang
(74) *Attorney, Agent, or Firm*—Madan, Mossman & Sriram, P.C.

(57) ABSTRACT

A liner hanger test packer assembly includes an axially translated liner top dressing mill having a calibrated shear mechanism for securing the mill at a first, top dressing position. Tool string load on the mill bearing upon the liner top in excess of the calibrated shear mechanism allows the mill to shift to a second axial position where abutment edges around the Mill base engage a tripping mechanism to drive slips against the casing wall above the liner hanger. The tripping mechanism also expands the packer seal against the casing I.D. above the liner hanger. No additional load may be imposed on the liner hanger after the anchor slips have engaged.

11 Claims, 3 Drawing Sheets

LINER TOP TEST PACKER

CROSS-REFERENCE TO RELATED PRIOR APPLICATIONS

The present application is derived from U.S. Provisional Application Ser. No. 60/355,217 filed Feb. 7, 2002 and claims all corresponding priority rights and privileges.

FIELD OF THE INVENTION

The present invention relates to the industrial arts of subterranean well drilling. More particularly, the invention relates to apparatus and methods for setting and sealing a packer for testing a well liner hanger installation.

BACKGROUND OF THE INVENTION

Typically, the borehole wall of an oil or gas well is lined with a heavy-weight steel pipe that is secured in place by cement. The cement is injected into the annulus between the pipe O.D. and the raw-cut wall of the bore-hole. The first string of such cement-set pipe extending down from the surface or rig floor is generally characterized as surface casing. For many reasons, such as an extremely deep well, one or more smaller diameter casings may be suspended from the bottom end of the surface casing. Often, the smaller, internal casing is characterized as a casing liner or simply, a liner.

The mechanism for suspending a liner from within the substantially smooth, internal bore wall of an up-hole support casing, for example, is a plurality of pipe slips around the perimeter of the liner pipe near the liner pipe upper end. These slips have rows of hardened teeth, points or edges that penetrate the inside wall of the support casing as the teeth are forced radially out from the liner by cooperative wedge faces. Once set, the slip teeth (wickers) penetrate the support casing wall as a function of the suspended weight. When extremely long and/or heavy liners are suspended, attention is given to the capacity of the upper support casing for supporting the weight suspended from it.

The liner hanger usually includes means for pressure sealing the hanger joint whereby the interior bore of the casing/liner is hydrodynamically isolated from the casing/liner exterior. Testing the integrity of the hanger seal is a brief but important step in the well completion sequence.

Traditionally, the integrity of a liner hanger is tested by plugging the liner mouth with an elastomer plug seal (packer) around the annulus between the workstring tubing and the internal bore wall of the liner. Subsequently, the upper well annulus is pressurized to monitor the reverse flow response to the hydrostatic pressure head within the workstring bore. The risks attendant with this traditional procedure, however, include, first, the loading forces on the elastomer plug to seal it in the liner bore. These forces are entirely carried by the liner hanger. Secondly, the hydraulic test pressure differentials are carried by the liner sectional area. These pressure differentials may be considerable and are also carried directly by the liner hanger. Accordingly, when added to the load of a heavy liner, loads imposed as an incident of testing a liner hanger may exceed the support capacity of the hanger and/or the support casing.

It is, therefore, an object of the present invention to provide the art with a tool and procedure for limiting the pressure load on a liner hanger when testing the integrity of the hanger pressure seal.

Also an object of the invention is a liner top test packer that seals the annulus between the workstring and the casing that supports the liner hanger.

Another object of the invention is a liner top test packer that is set against the support casing bore in conjunction with workstring anchor slips.

SUMMARY OF THE INVENTION

These and other objects of the invention as will become apparent from the following description of the preferred embodiments of our invention, are obtained by a liner top test packer having a top dressing mill tool that is linked to the pack-off mechanism with an independent anchor mechanism.

In a preferred embodiment of the invention, the present liner top test packer may be run into the well in conjunction with a casing clean up string after the wellbore liner system has been cemented. At this point in the well drilling or completion sequence, the casing liner has been secured to the upper support casing and possibly cemented. In the course of these events, the liner top may be scarred and in need of "dressing" to remove any burrs or steel slivers that could damage elastomer bore seals or packing elements that may subsequently pass through the liner hanger.

The present invention test packer comprises an expandable elastomer boot secured to a tool sub in the rotatable, tubular workstring or drillstring. The expandable boot shall hereafter be characterized as a "packer" but should also be understood to include other such descriptive terms such as "bridge plug". The packer may be expanded across an annulus between the workstring outer perimeter and the inside wall of the well casing. The radial force of an axially translated tubular cone element is one mechanism by which the packer may be expanded. Often, the packer is expanded against the upper support casing bore above but in close proximity with the liner hanger.

Axial translation of a tubular cone for expanding and sealing the packer element may be provided by the liner top dressing mill positioned in the workstring below the packer. Operationally, the top dressing mill lightly and briefly contacts the upper edges of the liner to remove any burrs, snags or residual cement. The dressing mill is secured to the packer tool sub by a linkage mechanism having a rotary drive connection. The rotary drive connection includes a calibrated shear restraint mechanism that accommodates a limited axial load between the mill and tool sub.

When workstring load imposed on the dressing mill tool exceeds the calibrated capacity of the shear restraint mechanism, failure of the shear restraint mechanism allows the mill to translate along the packer sub to actuate a tripping mechanism, secure the casing slips and set the test packer. When the test packer slips are set, no additional workstring load may be transferred to the liner hanger albeit additional workstring load may be imposed on the test packer to increase the sealing load.

The liner top seal with the upper casing is tested thereafter by imposing fluid pressure along either the flow bore of the workstring or the upper well annulus.

BRIEF DESCRIPTION OF THE DRAWINGS

The present invention and its advantages will be better understood by referring to the following detailed description and the attached drawings in which like reference numbers designate like or similar elements throughout the several drawing figures. Briefly.

DETAILED DESCRIPTION Of THE PREFERRED EMBODIMENTS

Figure 1:
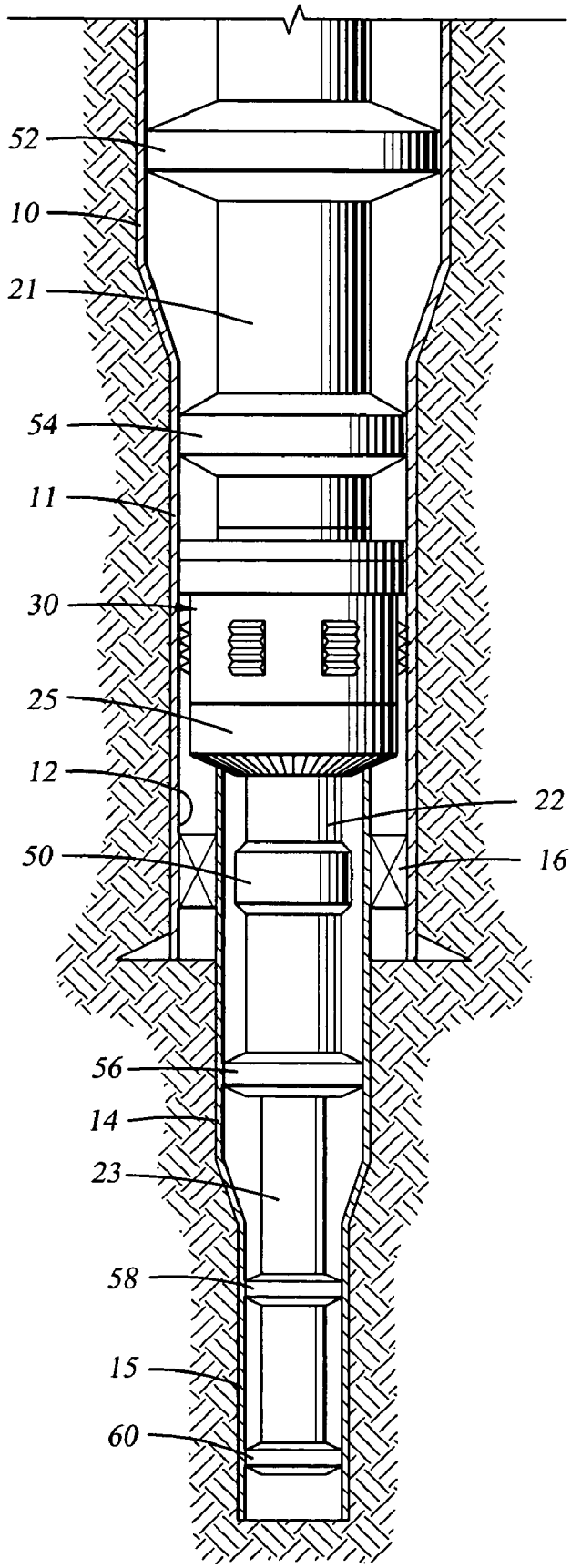
FIG. 1 schematic of a tapered string borehole.

For the purpose of environmental setting, a typical tapered string borehole is represented by the schematic of FIG. 1 and may include, for example, a 10.75" surface casing 10 and a 9.625" intermediate casing 11. The surface casing 10 and intermediate casing 11 are secured in the borehole by cement. Further down the wellbore, a 7" liner 14 is suspended from the end of the 9.625" casing 11 by a liner hanger 16. The wellbore lining may be continued below the 7" liner with a 5.5" bottomhole liner 15.

The workstring that supports and works within such a tapered wellbore typically comprises a surface string 21 having a 10.75" casing scraper 52. Below the surface string 21 is an intermediate string 22 that carries a 9.625" casing scraper 54. Below the casing scraper 54 is a liner top test packer 30. Below the test packer 30 is a liner top dress mill 25. Below the liner top dress mill is a polished bore receptacle mill 50 and a 7" casing scraper 56. The bottomhole workstring 23 typically may carry a 5.5° casing scraper 58 and a 5.5" end mill 60.

Figure 2:
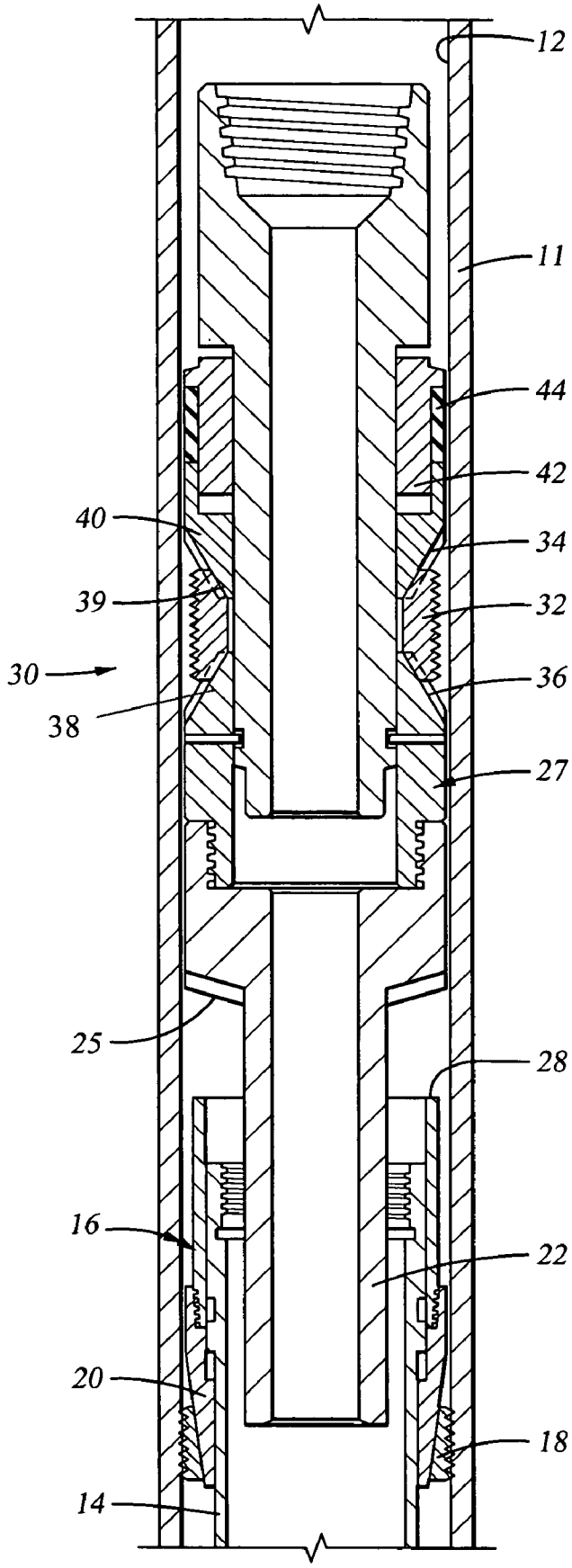
FIG. 2 is a schematic of the present liner top test packer and dressing mill assembly in the well run-in condition; and, FIG. 3 is a schematic of the present liner top test packer and dressing mill assembly in the well set condition.

Referring to FIG. 2, the liner hanger 16 that supports the upper liner 14 from the casing 11 relies upon slips 18 for gripping the inside wall 12 of the casing. A conical ring 20, secured to the upper end of the liner pipe 14, bears against the slips 18 to radially expand them into the inside casing wall surface 12.

After the liner 14 is set on the hanger 16, it may be desired to cement the liner, at least partially, in the extended borehole. Accordingly, a measured quantity of casing cement is pumped down the bores of casings 10 and 11 into and through the bores of liners 14 and 15. Positive displacement of the cement from the liner bores extrudes it into the spatial annulus between the exterior surface of the liners and the raw wellbore wall, for example.

Although the cement quantity is followed by a pump-down wiper plug, the casing and liner bores may remain contaminated with residual cement. Removal of such residual contamination is facilitated by the scraping and milling tools for "chasing" and polishing the casing and liner bore surfaces.

The liner top dressing mill 25 is secured to the bottom of a mechanical tripping mechanism 27. The top of the tripping mechanism is secured to the bottom end of the liner top test packer 30 in such a manner as to transmit rotary drive torque from the end of the liner top packer sub 30. This may be by means of meshed, longitudinal splines or a keyway, for example.

In addition to transmitting torque from the packer sub 30 to the tripping mechanism 27, the two elements are allowed limited relative axial displacement. To prevent axial separation of the two elements and transfer lift support of the intermediate workstring 22, the two elements are provided mutually engaging shoulders not shown. Axial displacement of the two elements 27 and 30 in the opposite or collapsing direction is limited by engagement of the anchor slips 32 with the inside wall 12 of the casing 11. A plurality of anchor slips 32 are distributed around the packer sub perimeter. Tapered end faces 36 on the tripping mechanism 27 respectively engage tapered end faces 38 on the anchor slips 32. Tapered face 34 on an axially sliding actuating ring 40 engages tapered end faces 39 on the anchor slips 32. Upon relative axial collapse between the tripping mechanism 27 and packer sub 30, the anchor slips 32 are displaced radially against the casing wall 12 by the converging taper faces 34 and 36.

Figure 3:
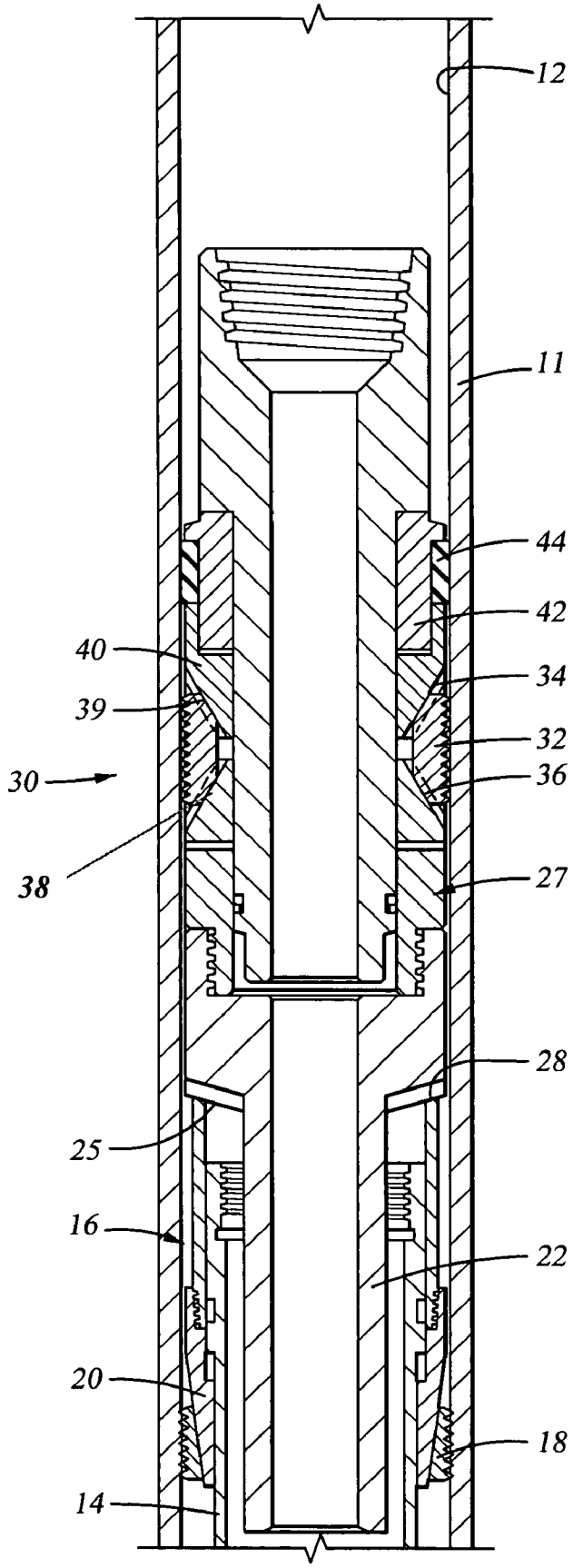

The packer sub 30 and liner tripping mechanism 27 are temporarily secured from relative axial movement during run-in as shown by FIG. 2. A calibrated shear mechanism such as a shear ring or shear screws is set to bridge the sliding interface between the packer sub 30 and tripping mechanism 27. When the compressive load between the two elements exceeds a calibrated shear stress value, the shear mechanism will fail. As represented by FIG. 3, failure of the shear mechanism allows the anchor slips 39 to be radially displaced against the casing wall 12 for direct support the workstring.

Similarly, a packing/sealing element 44 is compressed against the inside casing wall 12 by a compression sleeve 42. The compression sleeve 42 is integral with or adjacent to the actuating ring 40. The actuating ring 40 and compression sleeve 42 have an axially sliding fit along a cylindrical surface of the packer sub 30. When the compression load on the tripping mechanism 27 is sufficient to shear the retaining mechanism and cause the slips 32, to be translated against the casing wall 12, consequential load on the actuating ring 40 also loads the compression sleeve 42 against the packing/sealing element 44. Radial distortions of the packing/sealing element 44 against the inside wall 12 of the casing 11 imposed by the sleeve 42 annulus provide an effective fluid pressure seal Operatively, one purpose of the liner top mill is to clean or polish the top of the liner hanger by removing burrs and snags that could destroy elastomer bore seals passing the liner hanger. This polishing action requires relatively little weight on the mill tool and hence, little weight on the liner hanger. Preferably, the mill makes light contact with the liner hanger and is rotated slowly for 30 seconds, for example.

Another purpose served by contact of the dressing mill 25 with the liner top edge 28 is verification of the workstring depth and that the liner hanger has, in fact, been dressed. Such verification appears in the form of circumferential marking on the mill caused by the physical contact.

Relatively, the necessary down-load on the liner hanger 16 by the top mill 25 is small and may normally be accommodated by even a heavily loaded liner hanger. Accordingly, as the mill 25 completes the designated cleaning and polishing objectives and workstring rotation is terminated, the stationary mill 25 face will bear directly against the liner hanger top edge 28. Additional load imposed upon the liner hanger edge 28 by the workstring is transferred through the mill 25 to the tripping mechanism 27 thereby causing the shear retainer in the tripping mechanism 27 to fail. When the shear retainer fails, the standing load on the tripping mechanism drives the slips 32 against the casing wall 12. As the slips 32 engage the casing wall 12, compressive load of the workstring upon the liner hanger 16 is transferred to the casing 11.

Once the anchor slips 32 are set, additional workstring weight on the tripping mechanism 27 drives the compression sleeve 42 against the packing/sealing element 44 causing the element to expand to sealing contact with the casing 11 I.D. wall. Such additional sealing weight may be imposed on the packer without regard for the liner hanger 16 capacity since all of the workstring load is now transferred to the casing 11 at a loading position separate from the loading position of the liner hanger.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. A well workstring assembly comprising:

(a) an expandable sealing element for sealing an annulus between a workstring and a wall having a well bore liner hanger secured thereto;

(b) an expandable anchoring element for securing said workstring to the wall, wherein the anchoring element is adapted to engage the wall before the expandable sealing element seals against the wall; and (c) a liner hanger engagement tool having a rotational drive assembly with said workstring, and wherein said hanger engagement tool is a cutting mill.

2. A wellbore workstring having a packer assembled therewith, said packer comprising:

(a) an expandable bore sealing element adapted to seal a bore of the wellbore;

(b) an expandable bore anchoring element adapted to anchor the packer in a wellbore before the expandable sealing element seal the bore of the wellbore; and (c) a liner hanger top dressing mill coupled to the workstring.

3. A liner top test packer having an expandable sealing element, an expandable casing anchor element and a liner top milling tool, said milling tool connected to a tripping mechanism having a calibrated shear device whereby structural failure of said shear device expands said anchor element before the expanded sealing element is expanded.

4. A liner top test packer as described by claim 3 wherein structural failure of said shear mechanism also expands said sealing element and wherein the anchor element bears a loading stress while the sealing element is being expanded.

5. A method of testing the hydrodynamic seal of a wellbore liner hanger set within a supporting casing bore, the method comprising the steps of:

(a) assembling a wellbore workstring having a liner hanger engaging element, anchor slips and a packer element;

(b) running said workstring into a wellbore casing having a liner hanger;

(c) engaging said hanger engaging element against said liner hanger to set said anchor slips before engaging the packer element against said casing above said liner hanger; and (d) imposing a pressure differential across said liner hanger.

6. A method as described by claim 5 wherein said hanger engaging element is rotatively driven by said workstring.

7. A method as described by claim 6 wherein said hanger engagement element is axially translated from a first position to a second position to set said anchor slips and packer element.

8. A method as described by claim 6 wherein a rotative drive coupling of said hanger engaging element to said workstring is calibrated to restrict a transfer of engagement force to said anchor slips.

9. A method as described by claim 7 wherein said anchor slips and packer elements are engaged by exceeding a force capacity on a calibrated failure element between said workstring and said hanger engaging element.

10. A method as described by claim 8 wherein failure of said calibrated failure element allows said hanger engaging element to translate axially against said anchor slips.

11. A method as described by claims 9 wherein said hanger engaging element is a cutting mill.

* * * * *